US010208564B2

(12) United States Patent
Ravensbergen et al.

(10) Patent No.: US 10,208,564 B2
(45) Date of Patent: Feb. 19, 2019

(54) TUBULAR AIRLOCK ASSEMBLY

(71) Applicant: NCS Multistage, LLC, Calgary, Alberta (CA)

(72) Inventors: John Ravensbergen, Calgary (CA); Juan Montero, Calgary (CA)

(73) Assignee: NCS MULTISTAGE INC., Calgary, Alberta (CA)

( * ) Notice: Subject to any disclaimer, the term of this patent is extended or adjusted under 35 U.S.C. 154(b) by 127 days.

(21) Appl. No.: 15/286,306

(22) Filed: Oct. 5, 2016

(65) Prior Publication Data

US 2017/0096875 A1 Apr. 6, 2017

Related U.S. Application Data

(60) Provisional application No. 62/238,001, filed on Oct. 6, 2015.

(51) Int. Cl.

| | |
|---|---|
| ***E21B 34/06*** | (2006.01) |
| ***E21B 17/00*** | (2006.01) |
| ***E21B 43/12*** | (2006.01) |
| *E21B 43/24* | (2006.01) |

(52) U.S. Cl.

CPC ..... *E21B 34/063* (2013.01); *E21B 17/00* (2013.01); *E21B 43/12* (2013.01); *E21B 43/2406* (2013.01)

(58) Field of Classification Search

CPC ..... E21B 34/063

See application file for complete search history.

(56) References Cited

U.S. PATENT DOCUMENTS

| | | | | |
|---|---|---|---|---|
| 1,884,165 | A * | 10/1932 | Otis | E21B 43/10 137/68.16 |
| 3,779,263 | A * | 12/1973 | Edwards | E21B 34/063 137/68.25 |
| 3,831,680 | A * | 8/1974 | Edwards | E21B 21/10 166/311 |
| 5,479,986 | A * | 1/1996 | Gano | E21B 23/00 166/192 |
| 5,924,696 | A * | 7/1999 | Frazier | E21B 34/063 138/90 |
| 7,963,340 | B2 * | 6/2011 | Gramstad | E21B 34/063 166/376 |
| 8,813,848 | B2 * | 8/2014 | Frazier | E21B 34/063 166/317 |
| 9,194,209 | B2 * | 11/2015 | Frazier | E21B 33/1204 |
| 9,291,031 | B2 * | 3/2016 | Frazier | E21B 34/10 |
| 9,382,778 | B2 * | 7/2016 | Frazier | E21B 34/063 |
| 9,540,904 | B2 * | 1/2017 | Petrowsky | E21B 34/063 |
| 9,593,542 | B2 * | 3/2017 | Getzlaf | E21B 33/14 |
| 9,739,114 | B2 * | 8/2017 | Frazier | E21B 34/063 |

(Continued)

*Primary Examiner* — Blake E Michener

(57) ABSTRACT

A rupture assembly that may be employed in the oilfield industry facilitates the deployment of a tubing string in a well. The rupture assembly may be installed at the bottom of the tubing string for the purpose of trapping air in a lateral section of the tubing, between the rupture assembly and an upper sealing assembly. As a result, the buoyant force in the lateral section reduces the drag encountered while running the tubing through the casing, thereby significantly reducing rig time, or permitting operations where none were possible previously. Once at landing depth, surface pressure may be added to burst and remove the seal and rupture assemblies.

19 Claims, 4 Drawing Sheets

(56) References Cited

U.S. PATENT DOCUMENTS

| | | | | |
|---|---|---|---|---|
| 2007/0251698 | A1* | 11/2007 | Gramstad | E21B 34/063 166/376 |
| 2009/0139720 | A1* | 6/2009 | Frazier | E21B 33/1204 166/295 |
| 2011/0284242 | A1* | 11/2011 | Frazier | E21B 34/063 166/376 |
| 2011/0284243 | A1* | 11/2011 | Frazier | E21B 34/063 166/376 |
| 2011/0315398 | A1* | 12/2011 | Ueland | E21B 34/063 166/376 |
| 2014/0083716 | A1* | 3/2014 | Frazier | E21B 34/063 166/376 |
| 2014/0216756 | A1* | 8/2014 | Getzlaf | E21B 33/14 166/376 |
| 2015/0068730 | A1* | 3/2015 | Frazier | E21B 34/063 166/181 |
| 2017/0022783 | A1* | 1/2017 | Yong | E21B 34/063 |
| 2017/0138153 | A1* | 5/2017 | Getzlaf | E21B 34/063 |

* cited by examiner

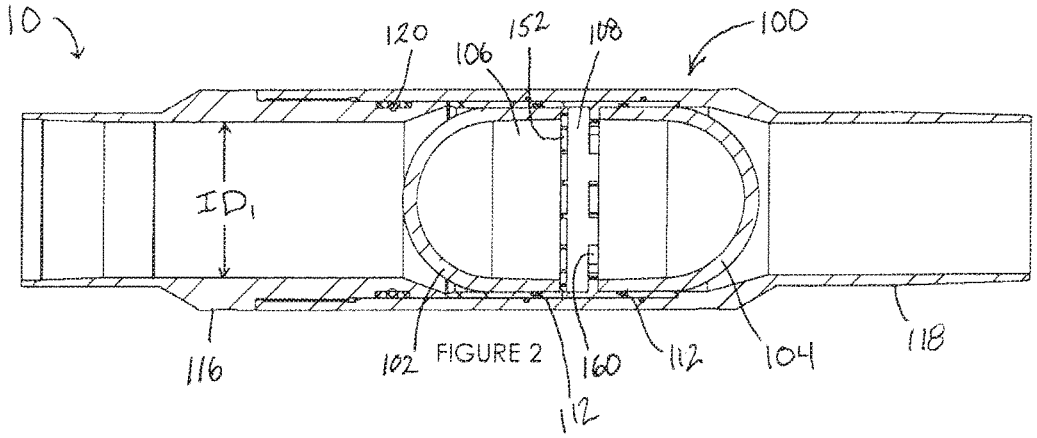
FIGURE 2
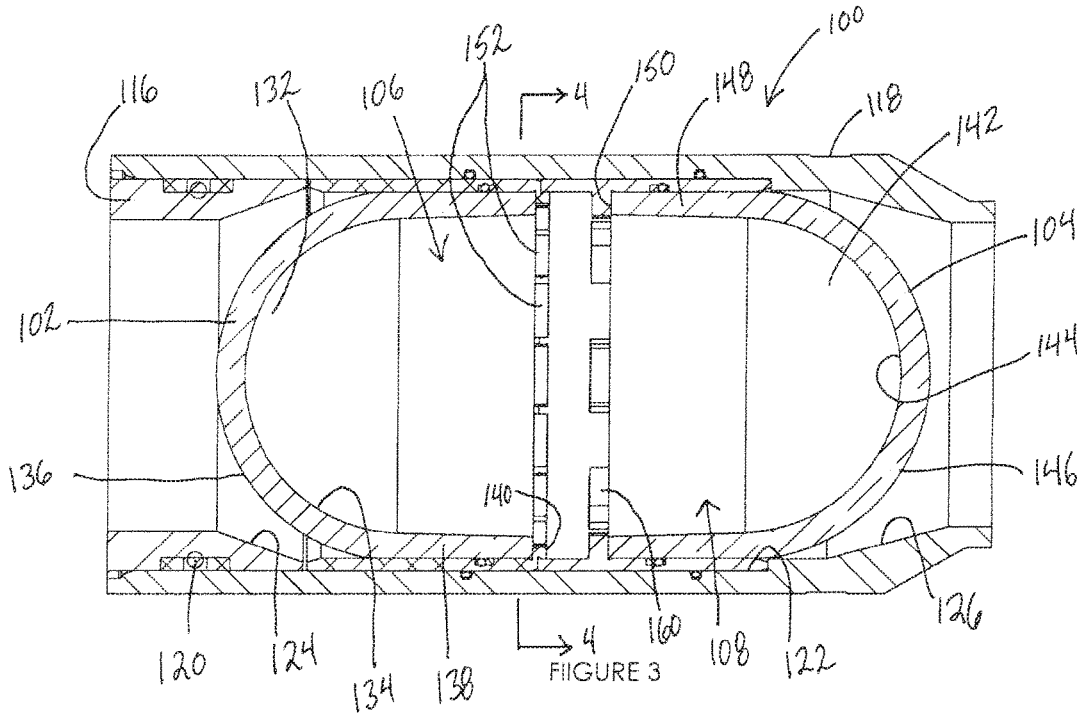
FIIGURE 3

TUBULAR AIRLOCK ASSEMBLY

CROSS-REFERENCE TO RELATED APPLICATIONS

This application claims the benefit of U.S. Provisional Application No. 62/238,001, filed on Oct. 6, 2015.

STATEMENT REGARDING FEDERALLY SPONSORED RESEARCH OR DEVELOPMENT

Not Applicable

BACKGROUND OF THE INVENTION

1. Field of the Invention

The present invention generally relates to an apparatus and method for facilitating deployment of a tubular string (i.e., tubing) in a casing string or wellbore. More specifically, the present invention provides a rupture assembly for use at the bottom of a tubing string that in conjunction with a sealing assembly higher up in the tubing string, creates an airlock or buoyancy chamber in the tubing to allow a float environment during deployment of the tubing where in the rupture and sealing assemblies are designed to rupture from applied hydraulic pressure in a way to make for easy removal of the pieces once the tubing is set at the desired depth in the casing string or wellbore.

2. Description of the Related Art Including Information Disclosed under 37 CFR 1.97 and 1.98

For conventional wells, such as in steam-assisted gravity drainage (SADG) wells, it is often difficult to run or deploy the tubing, which tends to be large OD (outer diameter) tubing, to great depths due to the friction created between the tubing string and the casing. Such friction results in a substantial amount of drag on the tubing. This is particularly true in horizontal and/or deviated wells. In some cases, the drag on the tubing can exceed the available weight in the vertical section of the wellbore. If there is insufficient weight in the vertical section of the wellbore, it may be difficult or impossible to overcome drag on the tubing in the wellbore, such that the weight cannot overcome the friction forces and stops the progress of the tubing string downhole, or in some scenarios where the friction force can be overcome, the outside of the tubing or inside of the casing may be damaged as the tubing is forced downhole.

Various attempts have been made to overcome the problem of drag and achieve greater well depths of the tubing in both vertical and horizontal sections of the well. For example, techniques to alter wellbore geometry are available; however these techniques are time-consuming and expensive. Also, techniques to lighten or "float" the tubing have been attempted to extend the depth of well. For example, there exists techniques in which the ends of a tubing string portion are plugged and the plugged portion is filled with a low density, miscible fluid to provide a buoyant force. After the plugged portion is placed in the wellbore, the plugs must then be drilled out so that the miscible fluid can be forced out into the wellbore. That extra step of drilling out the plugs increases completion time. Other flotation devices require a packer to seal the tubing above the air chamber. Another example of creating an air chamber is disclosed in U.S. Published Application No. 2014/0216756, entitled Casing Float Tool, the contents of which are hereby incorporated by reference in their entirety.

Therefore, a need exists for an apparatus and method that facilitates deployment of a tubing string in a casing string by creating and maintaining an airlock or buoyancy chamber, which is easy and relatively inexpensive to install on the tubing string. Furthermore, it would be desirable if the apparatus was easily removed from the wellbore and/or that the removal results in full tubing ID so that various downhole operations could be readily performed and maximum flow rate following removal or opening of the buoyant chamber.

BRIEF SUMMARY OF THE INVENTION

The present invention provides a rupture assembly that may be employed in the oilfield industry, such as in the SAGD area of the oil industry, to deploy the well's tubing string. The rupture assembly of the present invention may be installed at the bottom of the tubing string for the purpose of trapping air in a lateral section of the tubing, between the rupture assembly and an upper sealing assembly of one embodiment of the invention. As a result, the buoyant force in the lateral section minimizes the drag encountered while running the tubing through the casing, thereby significantly reducing rig time, or permitting operations where none were possible previously. Once at landing depth, surface pressure may be added to burst and remove the seal and rupture assemblies.

In accordance with an exemplary embodiment, the present invention provides a rupture assembly used in conjunction with a sealing assembly to create a buoyancy chamber in a tubing string. The rupture assembly includes a first rupture member held in sealing engagement by a disengageable securing mechanism, and a second rupture member downhole from the first rupture member held in sealing engagement by an impact member. The impact member has at least one impact surface. The first rupture member may be a hemispherical dome formed of high heat strengthened glass that has a convex surface facing uphole into the air chamber created in the tubing. The second rupture member may be a hemispherical dome formed of high heat strengthened glass that has a convex surface facing downhole towards the open end of the tubing. Application of a threshold hydraulic pressure in the tubing string above the rupture assembly (after the airlock is breached and the tubing fills with fluid) that is less than a rupture burst pressure of the first rupture member releases the first rupture member from the securing mechanism forcing the first rupture member to move downhole and impact against the at least one impact surface of the impact member and shatter into very small fragments that impact the second rupture member, which along with the hydraulic pressure, causes the second rupture member to shatter into very small fragments. In a preferred embodiment, the first and second rupture members are hemispherical domes formed of high heat strengthened glass, but could be any other substance, such as carbide that could be designed to withstand necessary pressures, but also shatter into small pieces for easy removal.

The present invention may also provide a tubing string that includes a length of tubing positionable in a wellbore, wherein said length corresponds generally to the length of the horizontal length of the tubing string for instance. A sealing member may be disposed at an upper end of the length of tubing for forming an upper boundary of an airlock or buoyancy chamber, and a rupture assembly may be disposed at a lower end of the tubing string for forming a lower boundary of the buoyancy chamber. The sealing assembly may be as shown in U.S. patent application Ser. No. 13/930,683 entitled Casing Float Tool and published as U.S. Pub. No. 2014/0216756, the contents of which are hereby incorporated by reference in their entirety. As the tubing is run into the hole, the rupture assembly is inserted into the tubing string at the bottom of the tubing string to prevent wellbore fluids and debris from entering the tubing string for the bottom of the string. As the tubing is run into the hole, air is filling the tubing string; in other embodiments other fluids could be used in the tubing string to create a similar buoyancy effect. Once the length of tubing equal to the expected horizontal length of tubing has been run into the hole, the sealing assembly can be inserted into the tubing string to seal the top of the airlock chamber to create the buoyancy section. Once the tubing has been run in to its final depth, the tubing above the sealing assembly can be filled with fluid so that a hydraulic pressure can be applied to the sealing element. When sufficient pressure is applied to for instance shear the securing mechanism, the first rupture member of the sealing element moves downhole and impacts the impact member and shatters, releasing the airlock. The remaining tubing can then be filled with fluid such that application of a threshold hydraulic pressure that is less than a rupture burst pressure of the first rupture member of the rupture assembly can be applied to release the first rupture member from the securing mechanism causing the first rupture member to impact against the at least one impact projection of the impact member and shatter into very small fragments that impact the second rupture member, which along with the hydraulic pressure, cause the second rupture member to shatter into very small fragments, opening the tubing string so that the shattered pieces can be circulated out of the well.

Other objects, advantages and salient features of the invention will become apparent from the following detailed description, which, taken in conjunction with the annexed drawings, discloses a preferred embodiment of the present invention.

BRIEF DESCRIPTION OF THE SEVERAL VIEWS OF THE DRAWING(S)

A more complete appreciation of the invention and many of the attendant advantages thereof will be readily obtained as the same becomes better understood by reference to the following detailed description when considered in connection with the accompanying drawing figures wherein:

FIG. 2 is a cross-sectional view of a rupture assembly of the tubular airlock assembly according to an exemplary embodiment of the present invention;

FIG. 3 is an enlarged cross-sectional view of the rupture assembly illustrated in FIG. 2;

DETAILED DESCRIPTION OF THE INVENTION

Figure 1:
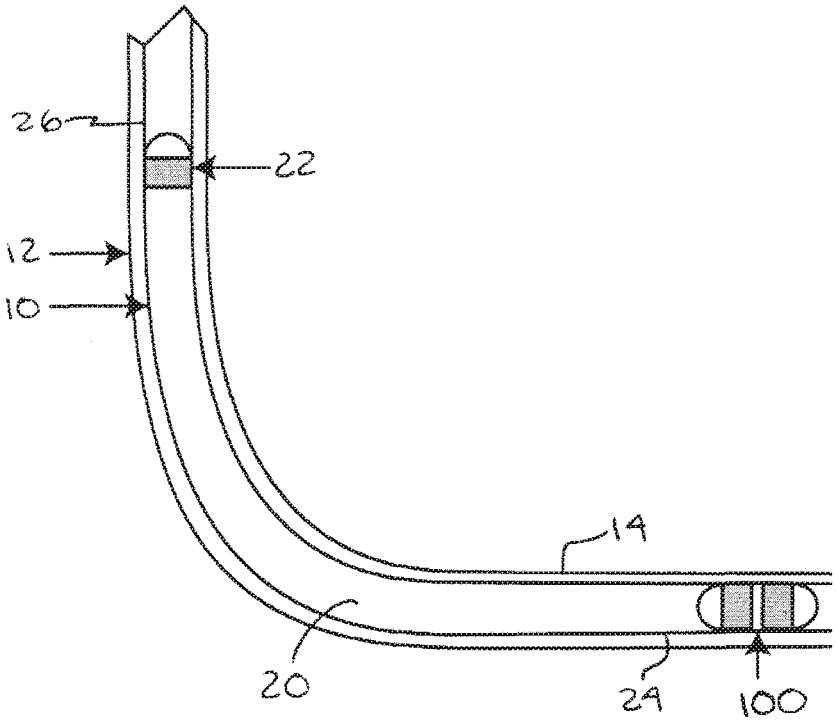
FIG. 1 is a cross-sectional view of a wellbore incorporating the sealing and the rupture assemblies according to an exemplary embodiment of the present invention.

In one particular exemplary embodiment of the invention, a In the following description, directional terms such as "above", "below", "upper", "lower", "uphole", "downhole", etc. are used for convenience in referring to the accompanying drawings. One of ordinary skill in the art will recognize that such directional language refers to locations in downhole tubing either closer or farther from the wellhead and that various embodiments of the present invention may be utilized in various orientations, such as inclined, deviated, horizontal, vertical, and the like.

Referring to FIGS. 1-6, the present invention relates to a tubular airlock assembly and method for facilitating deployment of a tubing string 10 into a wellbore 12. The tubular airlock assembly of the present invention preferably includes a rupture assembly 100 disposed in the tubing 10, that along with a sealing assembly 22, maintains an airlock or buoyancy chamber 20 in the tubing 10 to assist in positioning the tubing 10 in the wellbore 12, particularly in a horizontal section 14 of the wellbore 12. Once the tubing 10 is fully deployed to its desired vertical depth and/or horizontal position in the wellbore 12, the sealing assembly 22 is designed to easily rupture into very small fragments through application of hydraulic pressure allowing the buoyance chamber 20 to be filled with fluid from above. Once fluid fills the buoyancy chamber 20, the rupture assembly 100 is designed to easily rupture into very small fragments through the application of hydraulic pressure so that the fragments of the sealing assembly 22 and rupture assembly 100 may be circulated out of the well. The sealing assembly 22 and rupture assembly 100 in a preferred embodiment, once ruptured, do not reduce the inner diameter $ID_1$ (FIG. 2) of the tubing 10.

As seen in FIG. 1, the rupture assembly 100 of the present invention is preferably disposed at the toe or bottom of the tubing 10 to form a temporary isolation barrier to seal off the fluid from the wellbore 12 as the tubing 10 is being run therein, thereby maintaining and protecting the integrity of a buoyant chamber 20 in the tubing 10. The buoyant chamber 20 may be filled with air, or any fluid that provide buoyancy, to provide float to the tubing 10. The buoyant chamber 20 is formed between the rupture assembly 100, which is the lower boundary of the chamber, and a sealing assembly 22 located at or near the heel or upper part of the tubing 10, which is the upper boundary of the chamber. Air in the buoyant chamber 20 is trapped between the rupture assembly 100 of the present invention and the sealing assembly 22. The buoyant chamber 20 in the tubing 10 may be created as a result of sealing of the lower or toe end 24 of the tubing 10 with the rupture assembly 100 of the present invention and sealing of the upper or heel end 26 of tubing 10 with the sealing assembly 22. The distance between the rupture assembly 100 and sealing assembly 22 is selected to control the force tending to run the tubing into the hole and to maximize the vertical weight of the tubing.

The buoyant chamber 20 is air-filled to provide increased buoyancy, which assists in running the tubing 10 to the desired depth. That eliminates the need to fill the tubing 10 with fluid prior to running the tubing 10 in the wellbore 12, and there is no need to substitute the air in the tubing once installed in the well. The buoyant chamber 20 alternatively may be filled with other gases, such as nitrogen, carbon dioxide and the like. Light liquids may also be used. Generally, the buoyant chamber 20 is preferably filled with a fluid that has a lower specific gravity than the well fluid in the wellbore in which the tubing 10 is run. The choice of which gas or liquid to use may depend on factors, such as the well conditions and the amount of buoyancy desired.

Figure 5:
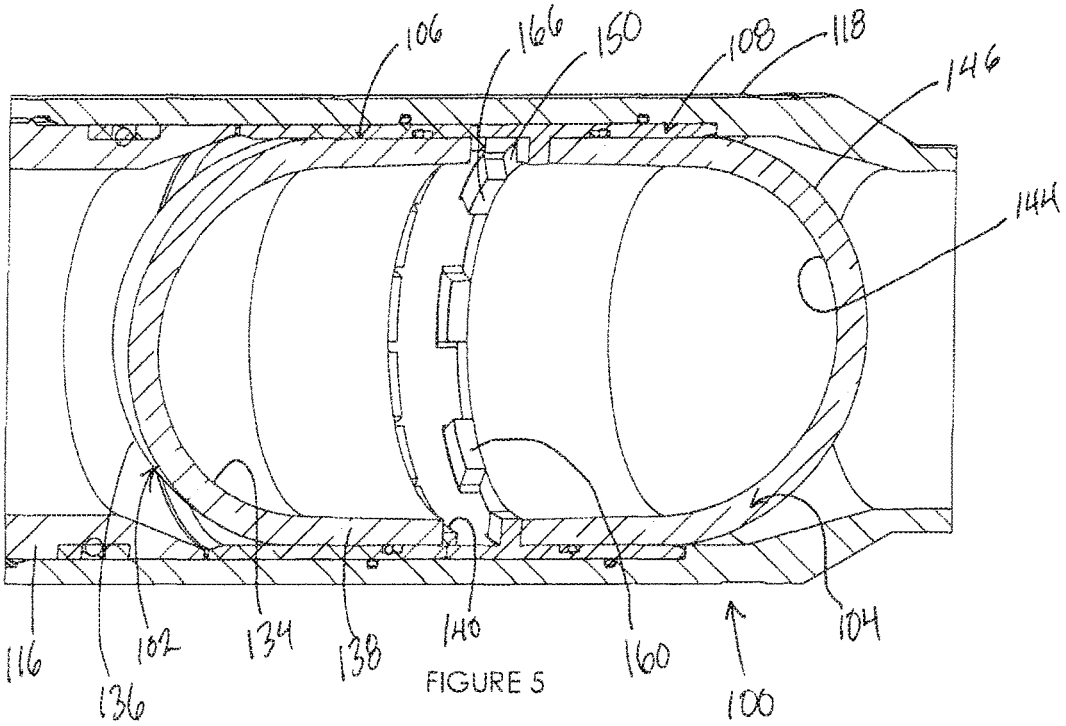
FIG. 5 is a cross-sectional view in perspective of the rupture assembly illustrated in FIG. 2.

Rupture assembly 100 generally includes first and second rupture members 102 and 104, a disengagable securing mechanism 106, an impact member 108, and a plurality of sealing O-rings 112, as best seen in FIGS. 3 and 5. Each of the rupture members 102 and 104 is preferably a hemispherical dome that is formed of a material having a burst or rupture pressure (i.e. the pressure at which hydraulic pressure alone can break the rupture member) greater than the hydraulic pressure in the tubing when the tubing is being run in the wellbore, so as to avoid premature breakage of the rupture members 102 and 104, thereby maintaining the seal for buoyant chamber 20. In a preferred embodiment, the dome shape of the second rupture member 104 can withstand 3500 psi or more without bursting. Once the tubing 10 is properly deployed, the rupture members 102 and 104 are fractured in very small fragments to remove the assembly and clear the fluid passageway of the tubing 10.

The rupture assembly 100 is sealed between an upper tubular member 116 that is coupled to a lower tubular member 118 through which a fluid passageway is defined. Upper tubular member 116 may be coupled with lower tubular member 118 in such a way that the outer wall of lower tubular member 118 overlaps at least a portion of the outer wall of upper tubular member 116. In the illustrated embodiment, the upper tubular member 116 and lower tubular member 118 are threadably coupled together at that overlap. Various other interconnecting means that would be known to a person skilled in the art are possible. A fluid seal between upper tubular member 116 and the lower tubular member 118 may be provided by one or more seals, such as O-ring seal 120.

The tubular members 116 and 118 provide a radially expanded area in the tubing 10 designed to accommodate the rupture assembly 100, so as to maintain the same inner diameter of the tubing. In particular, an internal recessed area 122 is defined in the inner surface of the lower tubular member 118 that is sized to receive the components of the rupture assembly, as seen in FIG. 2. The internal recessed area 122 is preferably sized such that the inner diameter $ID_1$ (FIG. 1) of the tubing 10 is substantially the same as the inner diameter $ID_2$ (FIG. 4) of the rupture assembly 100. The inner diameter may be 4.5 inches, for example. The recessed area 122 is flanked by an annular frusto-concial surface 124 of the upper tubular member 116 leading into the recessed area 122 and an annular frusto-conical surface 126 of the lower tubular member 118 behind the recessed area 122.

The rupture members 102 and 104 are preferably concentrically disposed in the tubular members 116 and 118 generally traverse to the longitudinal axis of the upper and lower tubular members 116 and 118 with the first rupture member 102 facing uphole and the second rupture member 104 facing downhole. The first rupture member 102 includes a portion 132 that is a hollow, hemispherical dome, with a concave surface 134 that faces downhole and a convex surface 136 that is oriented in the uphole direction. Hemispherical portion 132 is continuous with a cylindrical portion 138 which terminates in a circumferential edge 140 that abuts the disengagable securing member 106. Likewise, the second rupture member 104 includes a portion 142 that is a hollow, hemispherical dome, with a concave surface 144 that faces uphole and a convex surface 146 that is oriented in the downhole direction. Hemispherical portion 142 is continuous with a cylindrical portion 148 which terminates in a circumferential edge 150 that abuts the impact member 108.

In a preferred embodiment, the disengageable securing member 106 is a shear ring. The shear ring 106 may be sandwiched between the inner wall of lower tubular member 118 and the cylindrical portion 138 of first rupture member 102. An exemplary shear ring is described in U.S. Patent Application Publication No. 2014/0216756, incorporated herein by reference. The shear ring 106 provides for seating the first rupture member 102 in lower tubular member 118, and acts as a disengageable constraint while also facilitating the rupture of the rupture member 102, and generally being shearable in response to hydraulic pressure (e.g. being shearable or otherwise releasing the rupture member 102 in response to the application of a threshold hydraulic pressure that is less that the rupture burst pressure of the rupture member 102). The first rupture member 102 of the rupture assembly 100 is preferably designed so that up to 1800 psi of pressure may be applied before the securing member 106 releases or shears.

Figure 4:
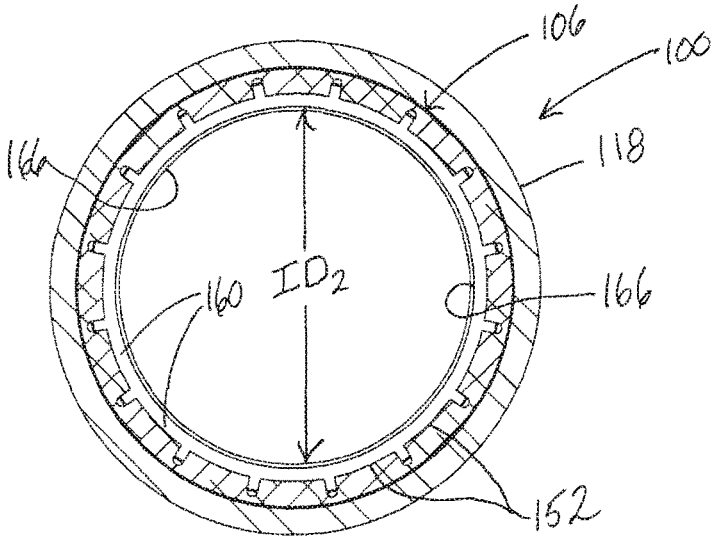
FIG. 4 is a cross-sectional end view of the rupture assembly taken along line 4-4 in FIG. 3.

The shear ring 106 has tabs 152 or other projections that can be sheared in response to hydraulic pressure, as seen in FIGS. 3-5. The tabs 152 are adapted to be eliminable from the tubing 10. The plurality of tabs 152 are preferably spaced around the circumference of a rim of the shear ring 106. Although shear ring 106 serves as the disengageable constraint or securing mechanism for the first rupture member 102 in the illustrated embodiment, other securing mechanisms to hold the rupture member 102 in sealing engagement within the tubing 10 may be possible, provided that rupture member 102 is free to move suddenly downward or across in the direction of the second rupture member 104, when freed or released from the constraints of the securing shear ring 106.

The first rupture member 102 may be sealed to shear ring 106 by means of one or more sealing O-rings 112. Each O-ring 112 may be disposed in a groove or void, circumferentially extending around the cylindrical portion 138 of the shear ring 106. Various back-up ring members may be present. The O-rings ensure a fluid tight seal as between the shear ring 106, the rupture member 102, and the upper and lower tubulars 116 and 118. The sealing engagement of the first rupture member 102 within shear ring 106 and the sealing engagement of shear ring 106 against the lower tubular member 118 together with the O-ring seals create a fluid-tight seal between the upper tubing and the tubing downhole of rupture assembly 100.

Tabs 152 of the shear ring 106 may be bendable or shearable upon application of force (e.g. hydraulic force). For example, tabs 152 may shear at 1000 to 2000 psi. This threshold pressure at which the securing mechanism 106 shears, releasing the first rupture member 102, is less than the rupture burst pressure of the rupture member 102 (i.e. the pressure at which the rupture member 102 would break in response to hydraulic pressure alone). Shear ring 106 may be made of any material that allows the tabs 152 to be suitably sheared off, such as metal (like brass, aluminum, and various metal alloys) or ceramics. The tabs 152 are also small enough that when sheared, they do not affect wellbore equipment or function.

Once all of the tabs 152 are sheared, the first rupture member 102 may be freed or released from the constraints of shear ring 106. The rupture member 102 then moves suddenly towards the impact member 108 in response to hydraulic fluid pressure already being applied to convex surface 136 of the first rupture member 102 such that it is pushed through the circumferential aperture of shear ring 106. Once disengaged or otherwise released from shear ring 106, the rupture member 102 will hit the impact member 108 and break into very small fragments as a result.

The impact device 108 is configured to provide at least one impact surface against which the first rupture member 102 breaks once the shear ring 106 releases the rupture member 102. Any surface of the impact device 108 may be the impact surface of the present invention, provided that the impingement of the first rupture member 102 with that surface causes the rupture member 102 to fracture. In a preferred embodiment, the impact device 108 is a carrier ring that includes one or more inwardly extending impact projections 160. The projections 160 may be annularly arranged and spaced from one another. Each projection 160 includes a first side surface 162 that faces toward the first rupture member 102, an opposite second side surface 164 faces toward the second rupture member 104, and an end face 166 extending between the side surfaces 162 and 164. The second side surfaces 164 may act as an abutment against the circumferential edge 150 of the second rupture member 104. The inner diameter $ID_2$ formed by the end faces 166 of the projections 160 is preferably substantially the same as the inner diameter $ID_1$ of tubing 10. That is, the structure of impact carrier ring 108 and the projections 160 facilitate the restoration of the tubing inner diameter because no or few portions of the impact carrier ring 108 and projections 160 extend into the inner diameter of the tubing 10.

The second rupture member 104 may be sealed to impact device 108 by means of a seal, such as the O-rings 112 disposed in one or more grooves circumferentially extending around a cylindrical portion 148 of the impact carrier ring 108. Various back-up ring members may be present. The O-rings ensure a fluid tight seal as between the impact carrier ring 106, the rupture member 104, and the upper and lower tubulars 116 and 118. The sealing engagement of the second rupture member 104 within impact carrier ring 108 and the sealing engagement of impact carrier ring 108 against the lower tubular member 118 together with the O-ring seals create a fluid-tight seal between the upper tubing and the tubing downhole of rupture assembly 100.

Any one of the first side surfaces 162 of the impact projections 160 may act as the impact surface of the present invention against which the first rupture member 102 is forced and breaks. When hydraulic pressure is applied to the rupture assembly 100 within the tubing 10, there is a combination of hydraulic pressure acting on the first rupture member 102, as well as compressive forces forcing the rupture member 102 into the impact device 108 (onto the one or more impact surfaces 162). The combination of the hydraulic force and the impact force against the impact surfaces 162 allow for shattering of the rupture disc 102.

The sudden release of energy from the impact of the first rupture disc 102 with the impact projections 160 in combination with the debris of the first disc 102 travelling past the projections 160, impacts the convex surface 146 of the second disc 104 and breaks the second disc 104 into very small fragments as well. The second rupture disc 104 may also impact any inner surface of the lower tubular member 118, such as frusto-conical surface 126, to further assist in fracture of the second rupture member 104. The shattering of the rupture discs 102 and 104 results in opening of the passageway of the lower tubular member 118, such that the tubing's inner diameter in that region of the lower tubular member 118 may be restored to substantially the same inner diameter as the rest of the tubing 10 (i.e. the tubing above and below the tubular or region in which the rupture assembly 100 was installed).

The first and second rupture members 102 and 104 are preferably made of a frangible material that shatters into very small fragments. Each very small fragment may not exceed more than 1 inch in any dimension, and preferably no more than ⅜ inch in any dimension. An exemplary material for the rupture members 102 and 104 is high heat strengthened glass. The high heat strengthened glass preferably has a nominal thickness of 0.100 inch to 0.500 inch, a refractive index of 1.489, a density of 2.33 g/cc, a linear thermal expansion of 43 E-7/C, a strain temperature of 482° C., a transition temperature of 512° C., an annealing temperature of 526° C., and a deformation temperature of 660° C. High heat strengthened glass is also preferably used for the sealing assembly 22. Other possible materials include carbides, ceramic, metals, plastics, porcelain, alloys, composite materials, and the like. These materials are frangible and rupture in response to the pressure differential when high pressure is applied. Hemispherical domes for the rupture members 102 and 104 are preferred because of their ability to withstand pressure from their convex sides 136 and 146. The convex side 146 of the second rupture member 104 in particular must have sufficient rupture strength to prevent premature fracture when the tubing 10 is run into the wellbore 12. In a preferred embodiment, the convex side 146 of the second rupture member 104 can withstand up to 3500 psi. Due to the nature of the dome shape of the second rupture member 104, the concave side 144 of the rupture disc 104 is much weaker than its convex side 146. As a result, the second rupture member 104 easily fractures due to impact with the ruptured pieces of the first rupture member 102. Thus, the structure and material of the rupture assembly 100 provides a way for a sealed tubing 10 to become unsealed while requiring less hydraulic pressure than prior art rupture disc approaches and without increasing the inner diameter of the tubing 10.

There is no need to send weights, sharp objects or other devices (e.g. drop bars or sinker bars) down the tubing 10 to break the rupture assembly 100 of the present invention like in some prior art techniques. In the present arrangement, the rupture assembly 100 is arranged so that the rupture discs 102 and 104 fracture into sufficiently small fragments those fragments can be easily removed by fluid circulation, without damaging the tubing 10. In addition, full tubing inner diameter $ID_1$ is restored after the rupture members 102 and 104 are broken, so that there is no need to drill out any part of the assembly 100. Once the rupture discs 102 and 104 have ruptured, normal operations may be performed. The rupture assembly 100 is straight-forward to install, avoids the cost and complexity of many known tubing flotation methods and devices, and decreases completion time.

Figure 6:
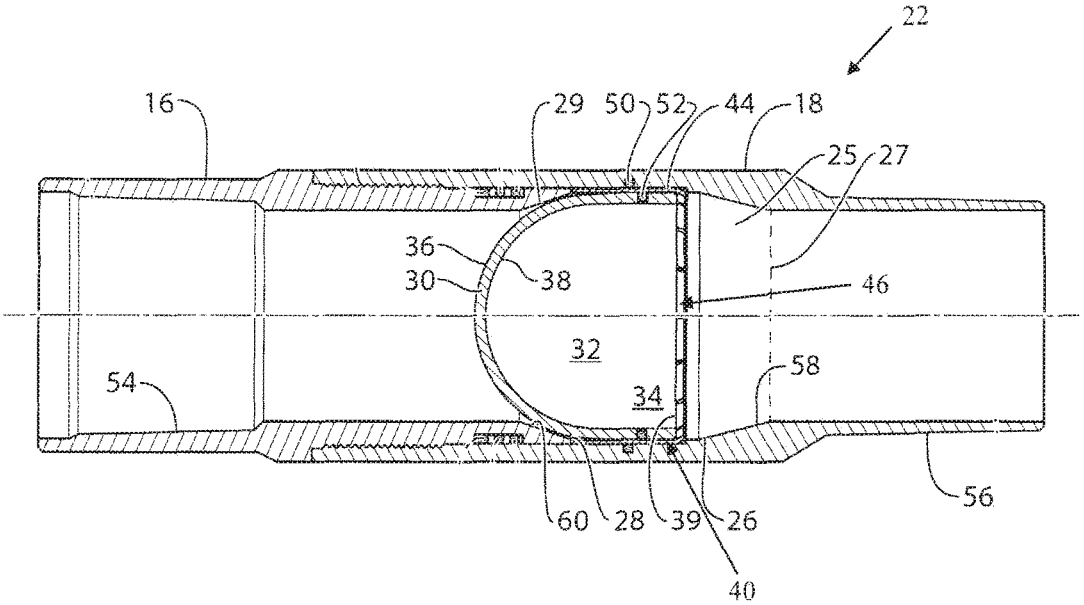
FIG. 6 is a cross-sectional view of the sealing assembly of the tubular airlock assembly according to an exemplary embodiment of the present invention.

In a preferred embodiment, the sealing assembly 22 is a rupture disc assembly, as seen in FIG. 6 and described in commonly owned U.S. Patent Application Publication No. 2014/0216756, the entire contents of which are hereby incorporated by reference. The sealing assembly 22 may be any conventional sealing mechanism for tubing and casing strings. The rupture disc assembly may consist of an upper tubular member 16 coupled to a lower tubular member 18, and a rupture disc 30 sealingly engaged between upper tubular member 16 and lower tubular member 18. The rupture disc 30 is preferably made of high heat strengthened glass, similar to rupture discs 102 and 104. Upper tubular member 16 may be coupled with lower tubular member in a manner similar to tubular members 116 and 118.

Lower tubular member 18 may include a radially expanded region 25 with a tapered internal surface 58, which may be a frusto-conical surface (e.g. lead-in chamfer). The radially expanded region 25 is continuous with a constricted opening (represented by dash line 27). Various surfaces on lower tubular member 18, most notably surface 58, can form impact surfaces for shattering the rupture disc 30. Upper tubular member 16 also has a radially expanded portion 29 to help accommodate disc 30.

Rupture disc 30 may be concentrically disposed traverse to the longitudinal axis of the upper and lower tubular members 16 and 18. In the illustrated embodiment, a portion 32 of rupture disc 30 is a hollow, hemispherical dome, with a concave surface 38 that faces downhole and a convex surface 36 that is oriented in the uphole direction. Hemispherical portion 32 is continuous with cylindrical portion 34 which terminates in a circumferential edge 39 having a diameter that is similar to the inner diameter of the radially expanded region 25 of lower tubular member 18 at shoulder 26. Rupture disc 30 is constrained from upward movement by tapered surface 60 on upper tubular member 16.

Shear ring 44 is an example of a securing mechanism for disc 30, the securing mechanism generally serving the purpose of holding the rupture disc 30 in the lower tubular member 18 helping to seal the rupture disc 30 in the tubing string 10, facilitating the rupture of the disc 30, and generally being shearable in response to hydraulic pressure (i.e. being shearable or otherwise releasing the rupture disc 30 in response to the application of a threshold hydraulic pressure that is less that the rupture burst pressure of the disc 30). As seen in FIG. 6, the shear ring 44 may be sandwiched between the inner wall of lower tubular member 18 and the walls of cylindrical portion 34 of rupture disc 30. Similar to shear ring 106, shear ring 44 provides for seating rupture disc 30 in lower tubular member 18, and acts as a disengageable constraint. A circular rim 40 of the shear ring 44 acts as seating for the circumferential edge 39 of rupture disc 30. Shear ring 44 preferably has tabs 46 or other projections extending inwardly from rim 40 that can be sheared in response to hydraulic pressure like tabs 152. The tabs 46 may be spaced around the circumference of the rim 40.

Shear ring 44 may be held between shoulder 26 of lower tubular member 18 and end 28 of upper tubular member 16 and may be sealed to lower tubular member 18 by an O-ring 50. Rupture disc 30 may be sealed to shear ring 44 by an O-ring 52. O-ring 52 may be disposed in a groove or void, circumferentially extending around the cylindrical portion 34 of disc 30. The O-rings ensure a fluid tight seal as between the shear ring 44, the rupture disc 30, and the upper and lower tubulars 16 and 18.

The threshold pressure at which the securing mechanism 44 shears, releasing the rupture disc 30, is less than the rupture burst pressure of the disc 30 (i.e. the pressure at which the disc would break in response to hydraulic pressure alone). Tabs 46 support and/or seat rupture disc 30. Once all of the tabs 46 are sheared, rupture disc 30 may be freed or released from the constraints of shear ring 44. Rupture disc 30 then moves suddenly downward in response to hydraulic fluid pressure already being applied to convex surface 36 of rupture disc 30, being pushed through the circumferential aperture 39 of shear ring 44. Once disengaged or otherwise released from shear ring 44, rupture disc 30 will impinge upon some portion of lower tubular member 18 (e.g. tapered surface 58, herein referred to as an example of an impact surface) and break into very small fragments as a result, preferably fragments that are less than ⅜ of an inch in any dimension. Thus, surface 58 serves as an impact surface. Surface 58, because it is angled, provides a wall against which the rupture disc is forced, and thus causes the disc to rupture. Any portion of the lower tubular 18 may constitute an impact surface, provided that the impingement of disc 30 with the surface causes the disc to rupture.

The sealing assembly 22 and rupture assembly 100 are preferably used in a method of installing the tubing 10 in the wellbore 12. Running a tubing 10 in deviated wells and in long horizontal wells, in particular, can result in significantly increased drag forces. The tubing may become stuck before reaching the desired location. This is especially true when the weight of the tubing in the wellbore produces more drag forces than the weight tending to slide the tubing down the hole. If too much force is applied to push the tubing into the well, damage to the tubing can result. The rupture assembly 100 of the present invention helps to address some of these problems.

To install the tubing 10 in the wellbore 12, the tubing 10 is initially assembled at the surface including the incorporation of the sealing assembly 22 and the rupture assembly 100, trapping air therebetween in the buoyant chamber 20. The buoyant chamber 20 provides float to counteract any friction drag between the tubing walls with the walls of the wellbore 12. As the tubing 10 is run into the wellbore 12, the convex surface 146 of the second rupture member 104 resists fracture and remains intact against the hydrostatic pressure from the wellbore fluid. That is the hydrostatic pressure during run-in must be less than the rupture burst pressure of the second rupture disc 104, to prevent premature rupture of the rupture disc 104. Generally, the rupture disc 104 may have a pressure rating of at least 3500 psi, for example.

Once the tubing has run and landed, the sealing assembly 22 and the rupture assembly 100 can be easily removed from the system and circulating equipment may be installed. The removal involves first bursting the sealing assembly 22 near the top of the tubing 10 by puncturing the same or applying sufficient fluid pressure. After the sealing assembly 22 is burst, and fluid fills the buoyancy chamber 20, sufficient fluid pressure is applied again to subsequently burst the rupture assembly 100. Alternatively, the sealing assembly 22 and the rupture assembly 100 can be burst at the same time using the same fluid pressure application. The fluid pressure (e.g., from the surface) is applied through the tubing 10 and exerts enough force on the first rupture member 102 and the shear ring 106, particularly tabs 160, to release the first rupture member 102. The first rupture member 102 of the rupture assembly 100 is preferably designed so that up to 1800 psi of pressure may be applied before the securing ring 106 releases or shears. That initiates the sequence of rupturing the first and second rupture members 102 and 104 and clearing the tubing fluid passageway, as described above.

Once the rupture assembly 100 has been ruptured, the inside diameter of the tubing 10 in the region of the rupture assembly 100 is substantially the same as that in the remainder of the tubing (i.e. the inner diameter $ID_1$ is restored following rupture of the rupture assembly 100). That is accomplished in the present invention by installing the rupture assembly 100 in the radially expanded area of the tubular members 116 and 118 along with sizing the tabs 152 (e.g. to form a 4.48 inch inner diameter) of the shear ring 106 and the projections 160 (e.g. to form a 4.15 inner diameter) of the impact carrier ring 108 to have an inner diameter that is substantially the same or greater than the inner diameter of the tubing. The ability to restore full tubing inner diameter is useful in achieving maximum flow rate quickly. It also allows downhole tools and the like to be deployed without restriction into the tubing 10. Also, further work can be done without the need to remove any parts from the tubing 10.

The foregoing presents particular embodiments of a system embodying the principles of the invention. Those skilled in the art will be able to devise alternatives and variations which, even if not explicitly disclosed herein, embody those principles and are thus within the scope of the invention. Although particular embodiments of the present invention have been shown and described, they are not intended to limit what this patent covers. One skilled in the art will understand that various changes and modifications may be made without departing from the scope of the present invention as literally and equivalently covered by the following claims.

What is claimed is:

1. A rupture assembly for a well tubing, comprising:

an upper tubular portion coupled to a lower tubular portion;

a first rupture member held in sealing engagement between the upper and lower tubular portions by a disengageable securing mechanism; and a second rupture member held in sealing engagement between the upper and lower tubular portions by an impact member, the impact member having at least one impact surface, wherein in operation:

the first rupture member is released from the disengageable securing mechanism when exposed to a threshold hydraulic pressure that is less than a rupture burst pressure of the first rupture member;

upon release from the disengageable securing mechanism, the first rupture member directly contacts the impact member causing the first rupture member to shatter into fragments; and the fragments directly contact that impact the second rupture member causing the second rupture member to shatter into fragments.

2. A rupture assembly according to claim 1, wherein the first rupture member is a hemispherical dome having a convex surface facing uphole of the well tubing, and the second rupture member is a hemispherical dome having a convex surface facing downhole of the well tubing.

3. A rupture assembly according to claim 2, wherein each hemispherical dome is formed of a frangible material.

4. A rupture assembly according to claim 3, wherein the frangible material comprises glass, ceramic, carbide, metal, plastic porcelain, an alloy or a composite.

5. A well tubing, comprising:

a length of tubing positionable in a wellbore;

a sealing assembly disposed at an upper end of the tubing for forming an upper boundary of a buoyant chamber; and a rupture assembly disposed at a lower end of the tubing for farming a lower boundary of the buoyant chamber, the rupture assembly including, an upper tubular portion coupled to a lower tubular portion, a first rupture member held in sealing engagement between the upper and lower tubular portions by a disengageabie securing mechanism, the first rupture member being a hemispherical dome formed of a frangible material having a convex surface facing uphole of the length of tubing, a second rupture member held in sealing engagement between the upper and lower tubular portions by an impact member, the impact member having at least one impact projection, the second rupture member being a hemispherical dome formed of a frangible material having a convex surface facing downhole of the length of tubing, wherein application of a threshold hydraulic pressure that is less than a rupture burst pressure of the first rupture member releases the first rupture member from the securing mechanism causing the first rupture member to impact against the at least one impact projection of the impact member and shatter into fragments that impact the second rupture member causing the second rupture member to shatter into fragments.

6. The well tubing of claim 5, wherein the frangible material comprises glass, ceramic, carbide, metal, plastic porcelain, an alloy or a composite.

7. The well tubing of claim 5, wherein the buoyant chamber comprises air.

8. The well tubing of claim 5, wherein the first rupture member is a hemispherical dome having a convex surface facing uphole of the well tubing, and the second rupture member is a hemispherical dome having a convex surface facing downhole of the well tubing.

9. The well tubing of claim 5, wherein the disengageable securing mechanism comprises a shear ring.

10. The well tubing of claim 9, wherein the shear ring comprises tabs bendable or shearable upon application of force.

11. The well tubing of claim 5, wherein the sealing assembly and rupture assembly have an inner diameter substantially the same as an inner diameter of the tubing.

12. The well tubing of claim 5, wherein the sealing assembly comprises a rupture disc.

13. A method of installing a length of tubing into a wellbore comprising:

running the length of tubing into the wellbore, wherein the length of tubing comprises a sealing assembly disposed at an upper end of the length of tubing for forming an upper boundary of a buoyant chamber and a rupture assembly disposed at a lower end of the length of tubing for forming a lower boundary of the buoyant chamber, the rupture assembly including, an upper tubular portion coupled to a lower tubular portion, a first rupture member held in sealing engagement between the upper and lower tubular portions by a disengageable securing mechanism, the first rupture member being a hemispherical dome formed of a frangible material having a convex surface facing uphole of the length of tubing, a second rupture member held in sealing engagement between the upper and lower tubular portions by an impact member, the impact member having at least one impact projection, the second rupture member being a hemispherical dome formed of a frangible material having a convex surface facing downhole of the length of tubing, wherein application of a threshold hydraulic pressure that is less than a rupture burst pressure of the first rupture member releases the first rupture member from the securing mechanism causing the first rupture member to impact against the at least one impact projection of the impact member and shatter into fragments that impact the second rupture member causing the second rupture member to shatter into fragments.

14. The method of claim 13, wherein the frangible material comprises glass, ceramic, carbide, metal, plastic porcelain, an alloy or a composite.

15. The method of claim 13, wherein the first rupture member and second rupture member assembly are installed in a radially expanded area of the upper and lower tubular portions.

16. The method of claim 15, wherein an inner diameter of the rupture assembly is substantially the same as or greater than an inner diameter of the tubing.

17. The method of claim 13, wherein the wellbore is a deviated wellbore.

18. The method of claim 13, wherein the wellbore is a horizontal wellbore.

19. The method of claim 13, wherein the buoyant chamber comprises air.

* * * * *